US009677337B2

(12) United States Patent
Bittleston et al.

(10) Patent No.: US 9,677,337 B2
(45) Date of Patent: Jun. 13, 2017

(54) TESTING WHILE FRACTURING WHILE DRILLING

(71) Applicant: SCHLUMBERGER TECHNOLOGY CORPORATION, Sugar Land, TX (US)

(72) Inventors: Simon Bittleston, Newmarket (GB); Ashley Bernard Johnson, Milton (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 295 days.

(21) Appl. No.: 14/349,017

(22) PCT Filed: Oct. 8, 2012

(86) PCT No.: PCT/IB2012/055431
§ 371 (c)(1),
(2) Date: Apr. 1, 2014

(87) PCT Pub. No.: WO2013/050989
PCT Pub. Date: Apr. 11, 2013

(65) Prior Publication Data

US 2014/0238668 A1 Aug. 28, 2014

Related U.S. Application Data

(60) Provisional application No. 61/544,027, filed on Oct. 6, 2011.

(51) Int. Cl.
*E21B 21/00* (2006.01)
*E21B 43/26* (2006.01)
(Continued)

(52) U.S. Cl.
CPC ..... *E21B 7/00* (2013.01); *E21B 21/00* (2013.01); *E21B 43/26* (2013.01); *E21B 49/08* (2013.01);
(Continued)

(58) Field of Classification Search
CPC . E21B 43/26; E21B 7/00; E21B 21/00; E21B 47/1025; E21B 49/00;
(Continued)

(56) References Cited

U.S. PATENT DOCUMENTS 2,783,026 A 2/1957 Reistle, Jr.
3,231,031 A 1/1966 Cleary
(Continued)

FOREIGN PATENT DOCUMENTS

EP 0718641 6/1996
RU 2280163 7/2006
(Continued)

OTHER PUBLICATIONS

International Search Report of PCT Application No. PCT/US2008/084620 dated Jul. 20, 2010: pp. 1-5.
(Continued)

*Primary Examiner* — Michael Wills, III
(74) *Attorney, Agent, or Firm* — Joan Beckner

(57) ABSTRACT

A drilling procedure is operated such that a formation around the wellbore being drilled is fractured and then reservoir fluids from a hydrocarbon reservoir contained in the formation are flowed into the wellbore where the flow of the reservoir fluids is tested. Production predictions for the wellbore are processed from the measurements made on the flow of reservoir fluids and decisions regarding further drilling operations are made based upon the reservoir fluid measurements. By testing reservoir fluids prior to completing the wellbore, drilling operations such as, for example,
(Continued)

continuing to drill the wellbore may be made without tripping the drillstring from the wellbore.

33 Claims, 6 Drawing Sheets

(51) Int. Cl.
*E21B 49/08* (2006.01)
*E21B 7/00* (2006.01)

(52) U.S. Cl.
CPC ..... *E21B 49/087* (2013.01); *E21B 2049/085* (2013.01)

(58) Field of Classification Search
CPC ..... E21B 49/005; E21B 49/008; E21B 49/08; E21B 49/087; E21B 2049/005
USPC ..... 175/40, 50, 72
See application file for complete search history.

(56) References Cited

U.S. PATENT DOCUMENTS

| | | | | |
|---|---|---|---|---|
| 3,248,938 | A | 5/1966 | Hill et al. | |
| 3,529,665 | A | 9/1970 | Malone | |
| 3,578,078 | A | 5/1971 | Shilander | |
| 4,867,241 | A | 9/1989 | Strubhar | |
| 5,472,049 | A | 12/1995 | Chaffee et al. | |
| 5,511,615 | A | 4/1996 | Rhett | |
| 5,730,219 | A | 3/1998 | Tabel et al. | |
| 6,021,377 | A | 2/2000 | Dubinsky et al. | |
| 6,176,323 | B1 | 1/2001 | Weirich et al. | |
| 6,427,530 | B1 | 8/2002 | Krueger et al. | |
| 6,435,277 | B1 | 8/2002 | Qu et al. | |
| 6,705,413 | B1 | 3/2004 | Tessari | |
| 6,837,309 | B2 | 1/2005 | Boney et al. | |
| 6,837,313 | B2 | 1/2005 | Hosie et al. | |
| 6,981,560 | B2 | 1/2006 | Nguyen et al. | |
| 7,044,239 | B2 | 5/2006 | Pinckard et al. | |
| 7,114,562 | B2 | 10/2006 | Fisseler et al. | |
| 7,174,975 | B2 | 2/2007 | Krueger et al. | |
| 7,174,978 | B2 | 2/2007 | Taniguchi et al. | |
| 7,252,162 | B2 | 8/2007 | Akinlade et al. | |
| 7,380,600 | B2 | 6/2008 | Willberg et al. | |
| 7,493,948 | B2 | 2/2009 | Cooper et al. | |
| 7,806,203 | B2 | 10/2010 | Krueger et al. | |
| 7,963,325 | B2 | 6/2011 | Johnson et al. | |
| 2002/0023752 | A1 | 2/2002 | Qu et al. | |
| 2004/0206494 | A1 | 10/2004 | Stephenson et al. | |
| 2005/0167159 | A1 | 8/2005 | Bailey et al. | |
| 2005/0230107 | A1 | 10/2005 | McDaniel et al. | |
| 2006/0062084 | A1 | 3/2006 | Drew | |
| 2006/0113077 | A1 | 6/2006 | Willgerg et al. | |
| 2006/0144620 | A1 | 7/2006 | Cooper et al. | |
| 2006/0196664 | A1 | 9/2006 | Hall et al. | |
| 2006/0225926 | A1 | 10/2006 | Madhavan et al. | |
| 2007/0045006 | A1 | 3/2007 | Krueger et al. | |
| 2007/0151762 | A1* | 7/2007 | Reitsma | E21B 21/08 175/40 |
| 2007/0284106 | A1 | 12/2007 | Kalman et al. | |
| 2008/0108524 | A1 | 5/2008 | Willberg et al. | |
| 2009/0095474 | A1 | 4/2009 | Lesso et al. | |
| 2009/0145660 | A1 | 6/2009 | Johnson et al. | |
| 2009/0151938 | A1 | 6/2009 | Conkle et al. | |
| 2010/0243242 | A1* | 9/2010 | Boney | E21B 43/26 166/250.01 |
| 2010/0268469 | A1* | 10/2010 | Harrison | G01N 9/002 702/12 |
| 2011/0139464 | A1 | 6/2011 | Henderson et al. | |

FOREIGN PATENT DOCUMENTS

| | | |
|---|---|---|
| UZ | 162 | 6/2003 |
| WO | 9842948 | 10/1998 |
| WO | 0161146 | 8/2001 |
| WO | 0250398 | 6/2002 |
| WO | 02088522 | 11/2002 |
| WO | 03048525 | 6/2003 |
| WO | 2009077715 | 6/2009 |
| WO | 2009087069 | 7/2009 |
| WO | 2009094066 | 7/2009 |

OTHER PUBLICATIONS

Examination Report of Gulf Corporation Council Application No. GCC/P/2008/12322 dated Sep. 8, 2012: pp. 1-4.
International Search Report of PCT Application No. PCT/IB2012/055431 dated Feb. 26, 2013: pp. 1-4.
Carman, "Fluid Flow Through Granular Beds," Transactions of the Institution of Chemical Engineers, 1937, vol. 15: pp. 150-166.
Hewett et al., "SPE 39945: Induced Stress Diversion: A Novel Approach to Fracturing Multiple Pay Sands of the NBU Field, Uintah Co., Utah," SPE International, 1998: pp. 375-383.
Kneissl, "SPE/IADC 67690: Reservoir Characterization Whilst Underbalanced Drilling," SPE International, 2001: pp. 1-9.
Martins et al., "Tip Screenout Fracturing Applied to the Ravenspurn South Gas Field Development," SPE Productions Engineering, Aug. 1992: pp. 252-258.
Smith et al., "Tip Screenout Fracturing: A Technique for Soft, Unstable Formations," SPE Production Engineering, May 1987: pp. 95-103.
Smith, et al., "Tip Screenout Fracturing: A Technique for Soft, Unstable Formations", SPE 13273, Society of Petroleum Engineers, May 1, 1987, 9 pages.
Hewett, et al., "Induced Stress Diversion: A Novel Approach to Fracturing Multiple Pay Sands of the NBU Field, Uintah Co., Utah", SPE 39945, Society of Petroleum Engineers, Jan. 1, 1998, 9 pages.
Martins et al., "Tip Screenout Fracturing Applied to the Ravenspurn South Gas Field Development", SPE 19766, Society of Petroleum Engineers, Aug. 1, 1992, 7 pages.

* cited by examiner

TESTING WHILE FRACTURING WHILE DRILLING

CROSS-REFERENCE TO RELATED APPLICATIONS

This application is a U. S. National Stage Application under 35 U.S.C. §371 and claims priority to Patent Cooperation Treaty Application No. PCT/IB2012/055431 filed Oct. 8, 2012, which claims the benefit of U.S. Provisional Patent Application Ser. No. 61/544,027 filed Oct. 6, 2011. Both of these applications are incorporated herein by reference in their entireties.

BACKGROUND OF THE DISCLOSURE

This disclosure relates in general to drilling a wellbore in an earth formation so as to extract hydrocarbons from subterranean reservoirs therein and, more specifically, but not by way of limitation, to testing the hydrocarbons being produced from the subterranean reservoirs during the drilling procedure.

In typical drilling operations, a turntable on the floor of a drilling rig rotates a string of hollow steel pipes, known as drill pipe or drillstring. A drill bit is disposed at the end of the drill pipe and is rotated against the formation at the drill bit face. The drill bit grinds, crushes and chips through the rock as it is rotated by the drill pipe. A drilling fluid, often referred to a drilling mud or mud, is pumped from the surface through the drill pipe to the drill bit, where the drilling fluid flushes the rock cuttings from the drill bit face and lubricates the drill bit. The drilling fluid circulates in the wellbore flowing out through the drill bit and then returning up the annular space between the outside of the drill string and the sidewalls of the wellbore being drilled; this annular space is often referred to as the drilling annulus.

The drilling fluid or mud cools and lubricates the bit, carries the drill cuttings from the hole to the surface and cakes the sidewall of the wellbore to seal the wellbore and prevent the sidewall caving in. The cake formed on the sidewall is often referred to as filter cake. Sealing of the sidewalls is important as it prevents loss of the circulating drilling fluid to the earth formation surrounding the wellbore.

The hydrostatic pressure exerted by the column of drilling fluid in the wellbore prevents blowouts/inflow of reservoir fluids into the wellbore that may result, for example, when the wellbore penetrates a section of the subterranean formation comprising a high pressure oil or gas zone. Such an influx of oil or gas into the wellbore from the reservoir during drilling creates an adverse effect known as a kick, which is a highly undesirable affect that can have many adverse effects to the drilling operation. Thus, in a traditional drilling operation, the weight in pounds per gallon ("ppg") of the drilling fluid must be sufficiently high to prevent blowouts/kicks, but not high enough to generate a downhole pressure in the wellbore that causes the sidewalls of the formation around the wellbore to fracture resulting in the drilling fluid flowing out of the wellbore through the fractures and into the formation, resulting in drilling fluid loss and break down of the drilling procedure. In other words, if the mud pressure is too low, the formation fluid surrounding the wellbore can force the filter cake from the sidewall of the wellbore and flow into the wellbore, resulting in a blowout/kick. Whereas if the bottomhole pressure produced by the drilling fluid becomes too high, the differential pressure between the wellbore and the surrounding formation becomes great enough that the formation fractures and drilling fluid flows out of the wellbore and into the formation, resulting in lost circulation.

Lost circulation is the loss of drilling fluids to the formation. The loss of drilling mud and cuttings into the formation results in slower drilling rates and plugging of productive formations. When circulation suddenly diminishes, the drilling rate or rate of penetration ("ROP") must be scaled back as the mud flow rate is reduced. Moreover, losing mud into productive formations can severely damage the formation permeability, lowering production rates therefrom. Such plugged formations must often be subjected to costly enhanced recovery techniques in an effort to restore the formation permeability to raise production rates back up to their former levels.

The drill string usually consists of 30-foot lengths of pipe coupled together. On the lower end of the drill string are heavier-walled lengths of pipe, called drill collars, which help regulate the weight on the bit. When the bit has penetrated the distance of a pipe section, drilling is stopped, the string is pulled up to expose the top joint, a new section of drill pipe is added, the string is lowered into the wellbore and drilling resumes. This process continues until the bit becomes worn out, at which time the entire drill string must be removed from the wellbore. The cost of running a rig for a period of time is extremely high. Therefore, the speed of drilling of the wellbore is extremely important and trips, removing the drill bit from and returning it back into the wellbore, are highly undesirable.

During drilling of the wellbore, steps are taken to keep the pressure at the bottom of the borehole in a pressure window that is not higher than the pressure necessary to fracture the formation, as such fractures will lead to loss of drilling fluids to the formation, and is higher than a pore pressure of the formation to prevent flow of formation fluids into the wellbore as such a influx may create a blowout and/or a kick.

Normally, once a wellbore has been drilled, it is lined or cased with heavy steel piping, called casing or casing string, and the annulus between the wellbore and the casing is filled with cement. Properly designed and cemented casing prevents collapse of the wellbore and protects fresh water aquifers above the oil and gas reservoir from becoming contaminated with oil and gas and the oil reservoir brine. Similarly, the oil and gas reservoir is prevented from becoming invaded by extraneous water from aquifers that penetrated above the productive reservoirs. The total length of casing of uniform outside diameter that is run in the well during a single operation is called a casing string. The casing string is made up of joints of steel pipe that are screwed together to form a continuous string as the casing is extended into the wellbore.

Once the wellbore has been drilled to a target location in the subterranean formation, a location in the earth formation containing an oil/gas reservoir, the wellbore must be prepared for production of the surrounding oil/gas. At this point, the drill bit and drillstring is normally tripped out of the wellbore. If the wellbore is cased with a casing string, the casing string is perforated and pressure at the bottom of the wellbore, may if necessary, be increased to fracture the surrounding formation. At this point, the oil and gas may flow into the wellbore and testing equipment, often deployed on a wireline tool may be disposed into the wellbore to test the properties of the oil/gas flowing into the wellbore so that a production plan can be created and a determination made as to the production properties of the wellbore.

BRIEF SUMMARY OF THE DISCLOSURE

In one embodiment, the present disclosure provides a method for performing a drilling procedure using a drillstring to drill a wellbore into a subterranean formation to produce hydrocarbons from a hydrocarbon reservoir therein, where the formation is fractured during the drilling process and formation fluids are flowed into the wellbore and tested without completing the wellbore and/or while the drillstring is still in the wellbore.

In an aspect of the present invention, the measurements of the formation fluids are processed and drilling decisions are made, such as whether to complete the well, whether to continue drilling the wellbore, determination of a direction of continued drilling, determination as to fracture placement decisions and/or the like. In some embodiments, the drillstring may comprise wired drillstring and the measurements of the formation fluids may be communicated to the surface by the wired drillstring and processed at the surface in essentially real-time.

In another embodiment, the present disclosure provides a method for performing a drilling procedure using a drillstring to drill a wellbore into a subterranean formation to produce hydrocarbons from a hydrocarbon reservoir therein, comprising pumping a first regular drilling fluid into the wellbore during the drilling procedure, pumping a second, high-density drilling fluid into the wellbore to increase a pressure at the bottom of the wellbore above a fracture pressure of the formation and as a result fracture the subterranean formation, pumping a third drilling fluid with a density lower than the second drilling fluid into the wellbore to lower the pressure at the bottom of the wellbore below a pressure of the subterranean formation and measuring properties of a flow of formation fluids flowing from the subterranean formation into the wellbore.

In aspects of the present invention, the volumes, pump rates and densities of the drilling fluids may be processed to provide the pressure changes in the wellbore necessary for drilling the well, fracturing the well and flowing formation fluids into the well. In aspects of the present invention, additional fluids may be entrained with the drilling fluids, such as fluids for sealing the fractures to provide for continued drilling of the wellbore after testing of the formation fluids, clean and or proppant carrying fluids to provide for effective fracturing of the formation and/or the like. In aspects of the present invention, pressure control devices and methods such as chokes, gas injection systems, drilling fluid pumps and or the like may be used to help control the wellbore pressure during the testing while fracturing while drilling process.

BRIEF DESCRIPTION OF THE DRAWINGS

The present disclosure is described in conjunction with the appended figures.

Figure 1A:
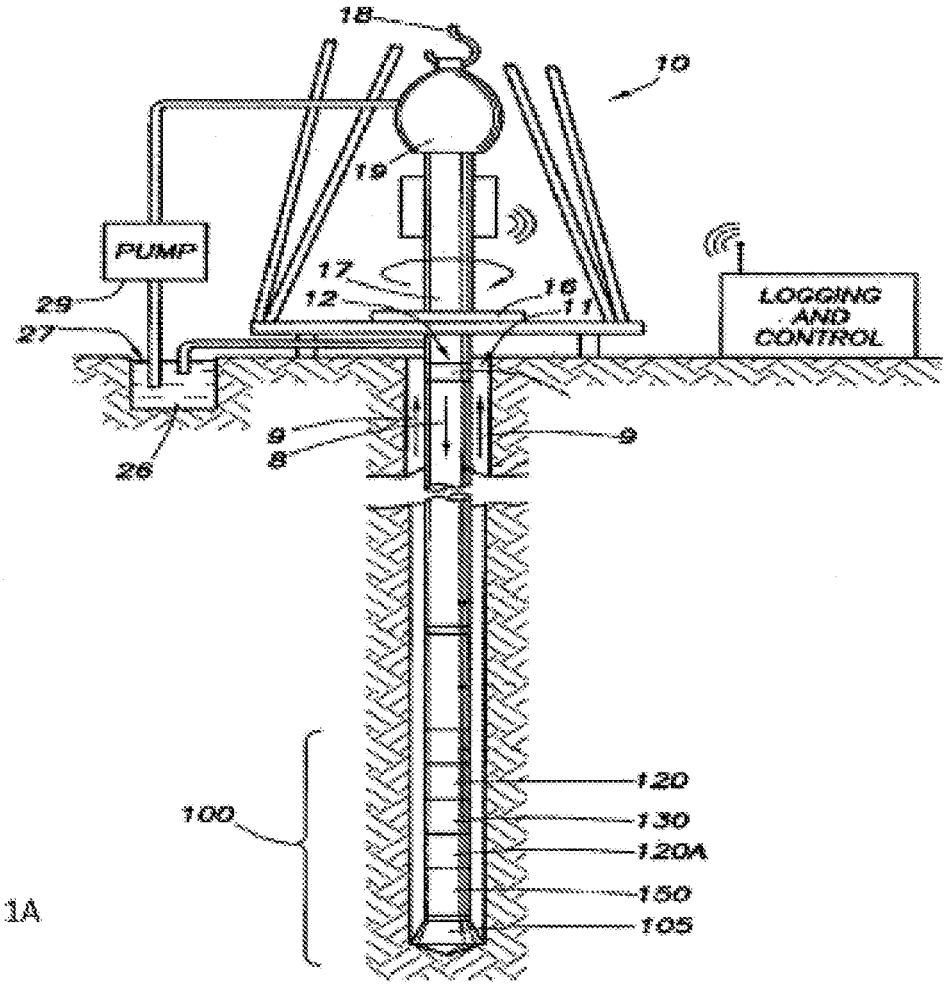
FIG. 1A illustrates a wellsite system in which embodiments of the present invention may be used to provide for drilling through an earth formation, fracturing the formation and testing properties of a flow of formation fluids into the wellbore being drilled.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1A illustrates a wellsite system in which embodiments of the present invention may be used to provide for drilling through an earth formation, fracturing the formation and testing properties of a flow of formation fluids into the wellbore being drilled. The wellsite may be onshore or offshore. In this exemplary system, a wellbore 11 is formed in subsurface formations by rotary drilling in a manner that is well known. Embodiments of the invention can also use directional drilling system in which downhole motors may be used to power the drill bit and the drill bit may either pointed in a desired direction or pushed in a desired direction, A drill string 12 is suspended within the wellbore 11 and has a bottom hole assembly 100 which includes a drill bit 105 at its lower end. The surface system includes platform and derrick assembly 10 positioned over the wellbore 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the wellbore, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment may comprise a logging-while-drilling ("LWD") module 120, a measuring-while-drilling ("MWD") module 130, a roto-steerable system, a motor and/or drill bit 105.

The LWD module 120 may be housed in a special type of drill collar, as is known in the art, and can contain one or a plurality of known types of logging tools. It will also be understood that more than one LWD and/or MWD module can be employed in the bottom hole assembly 100, e.g. as represented at 120A. (References, throughout, to a module at the position of 120 can alternatively mean a module at the position of 120A as well.) The LWD module may include capabilities for measuring, processing, and storing information, as well as for communicating with the surface equipment. The LWD module may include a fluid sampling device for sampling fluids from the formation surrounding the wellbore 11.

The MWD module 130 may also be housed in a special type of drill collar, as is known in the art, and may contain one or more devices for measuring characteristics of the drill string and drill bit. The MWD tool may further include an apparatus (not shown) for generating electrical power for the downhole system. This may typically include a mud turbine generator powered by the flow of the drilling fluid, it being understood that other power and/or battery systems may be employed. The MWD module may include one or more of the following types of measuring devices: a weight-on-bit measuring device, a torque measuring device, a vibration measuring device, a shock measuring device, a stick slip measuring device, a direction measuring device, and an inclination measuring device.

Figure 1B:
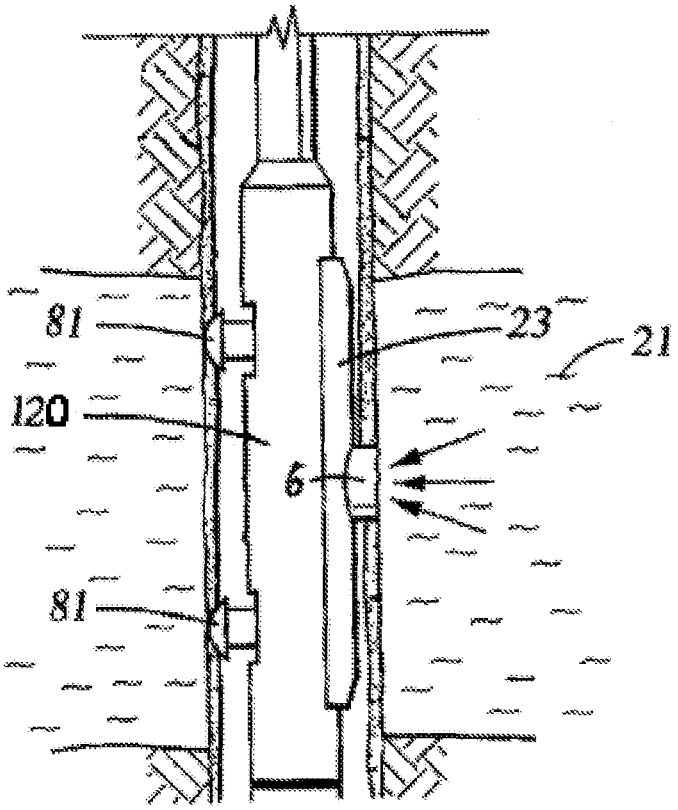
FIG. 1B is a simplified diagram of a sampling-while-drilling logging device of a type described in U.S. Pat. No. 7,114,562, incorporated herein by reference, utilized as the LWD tool 120 or part of an LWD tool suite 120A, which may be used to test properties of formation fluids entering an uncompleted wellbore, in accordance with embodiments of the present invention.

FIG. 1B is a simplified diagram of a sampling-while-drilling logging device of a type described in U.S. Pat. No. 7,114,562, incorporated herein by reference, utilized as the LWD tool 120 or part of an LWD tool suite 120A, which may be used to test properties of formation fluids entering an uncompleted wellbore, in accordance with embodiments of the present invention. The LWD tool 120 is provided with a probe 6 for establishing fluid communication with the formation and drawing the fluid 21 into the tool, as indicated by the arrows. The probe 6 may be positioned in a stabilizer blade 23 of the LWD tool and extended therefrom to engage the wellbore wall. The stabilizer blade 23 comprises one or more blades that are in contact with the wellbore wall. Fluid drawn into the downhole tool using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the drilling tool and/or probe against the wellbore wall.

FIG. 1A illustrates the drilling system that is used to drill a wellbore from the surface into a hydrocarbon reservoir. Once the wellbore has been drilled a process called completion is undertaken prior to producing hydrocarbons from the reservoir through the wellbore. Completion is the process of making a wellbore ready for production of hydrocarbons. Prior to completing the well, the drill pipe and drill is generally removed from the wellbore. Completion involves preparing the bottom of the wellbore to the required specifications, running in the production tubing and associated down hole tools as well as perforating the casing or liner of the well, if necessary, and stimulating the reservoir as required. In many cases, completion includes the process of running in and cementing the casing. As will be discussed in more detail below, unlike the conventional process of drilling the wellbore, completing the wellbore and the performing production testing of the reservoir fluids, in embodiments of the present invention, the wellbore is drilled, the reservoir is fractured and the formation fluids are tested prior to completing the wellbore for production and/or while the drillstring is still in the well.

Figure 2:
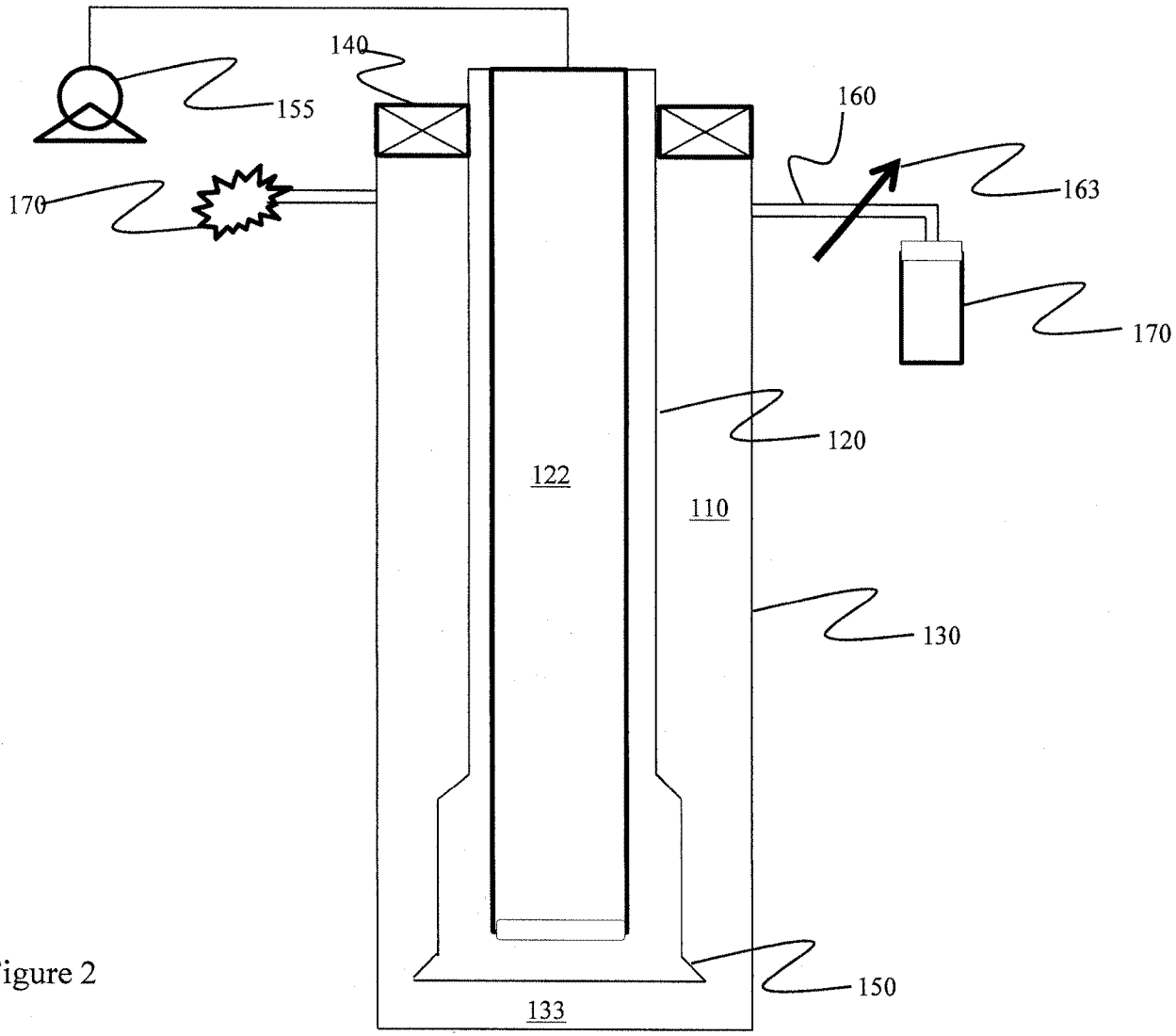
FIG. 2 illustrates a MPD system that may be used in a testing while fracturing while drilling system/process in accordance with an embodiment of the present invention.

FIG. 2 illustrates a MPD system that may be used in a testing while fracturing while drilling system/process in accordance with an embodiment of the present invention. To address the issues associated with maintaining the wellbore pressure in a window where it does not cause fracturing of the formation or allow inflow of the formation fluids into the wellbore, a process known as managed pressure drilling ("MPD") has been developed. In MPD various techniques may be used to control the bottomhole pressure ("BHP") in the wellbore during the drilling process.

In MPD, a drilling annulus 110 is formed between a drillstring 120 and a sidewall 130 of a wellbore 133, which is being drilled. Drilling fluid is pumped by a pump 155 into the drilling annulus 110. The drilling annulus 110 may be closed using a pressure containment device 140. This pressure containment device 140 comprises sealing elements, which engage with the outside surface of the drillstring 120 so that flow of drilling fluid between the pressure containment device 140 and the drillstring 120 is substantially prevented. The pressure containment device 140 may allow for rotation of the drillstring 120 in the wellbore 133 so that a drill bit 150 on the lower end of the drillstring 120 may be rotated.

A flow control device 160 may be used to provide a flow path for the escape of drilling fluid from the drilling annulus 110. After the flow control device 160, a pressure control manifold (not shown), comprising at least one adjustable choke 163, may be used to control the rate of flow of drilling fluid out of the drilling annulus 110. When closed during drilling, the pressure containment device 140 creates a backpressure in the wellbore, and this back pressure can be controlled by using the adjustable choke 163, which may comprise a choke, a valve and/or the like, on the pressure control manifold to control the degree to which flow of drilling fluid out of the drilling annulus 110 is restricted. The drilling fluid may flow into a collector/pit 170 and may then be recirculate in the drilling operation During MPD an operator/processor may monitor and compare the flow rate of drilling fluid into the drillstring 120, which comprises a pipe with a central cavity 122, with the flow rate of drilling fluid out of the drilling annulus 110, to detect if there has been a kick or if drilling fluid is being lost to the formation. A sudden increase in the volume or volume flow rate out of the drilling annulus 110 relative to the volume or volume flow rate into the drillstring 120 may indicate that there has been a kick. By contrast, a sudden drop in the flow rate out of the drilling annulus 110 relative to the flow rate into the drillstring 120 may indicate that the drilling fluid has penetrated the formation and is being lost to the formation during the drilling process. In general, in conventional drilling processes, both fracturing the formation during drilling and flowing formation fluids into the wellbore while drilling are occurrences to be avoided.

In MPD procedures the pump 155 and the choke 163 may be used to control the BHP during the drilling process. In some MPD processes, often referred to as multiphase MPD, gas injection may also be used to control the BHP. In such MPD procedures gas may be pumped by a compressor 172 into the drilling annulus 110 in order to reduce BHP. Often, the wellbore is lined with a pipe that is referred to as a casing string that may be cemented to the wellbore wall to, among other things, stabilize the wellbore and allow for flow of drilling fluids, production of hydrocarbons from the wellbore and/or the like. In such aspects, the drilling annulus may be formed by the annulus lying between the drillstring and the casing string.

Annular gas injection is an MPD process for reducing the BHP in a wellbore. In many annular gas injection systems, in addition to lining the wellbore with casing, a secondary annulus is created around the drilling annulus by placing an additional pipe concentrically around the casing for at least a section of the wellbore. This secondary annulus may be connected by one or more orifices at one or more depths to the primary annulus, through which the drilling fluids flow.

In an embodiment of the present invention, the illustrated MPD system may be used to provide for testing while fracturing while drilling. For example, the MPD system may be operated during the drilling process to create a bottom hole pressure that is higher than the formation fracture pressure and as a result fracture the formation. Increase in bottom hole pressure may be provided by the MPD system by use of the choke or other device for controlling flow of drilling fluids out of the drilling annulus, the pump rate/compression of the drilling fluid being pumped into the well and/or the like. The MPD system may then be used to reduce the bottom hole pressure below the pore pressure of the formation so that formation fluids will flow from the higher pressure formation into the lower pressure wellbore. Pressure in the bottom of the wellbore may be decreased by injecting gas into the drilling annulus, reducing choke of the drilling fluids flowing out of the drilling annulus and/or the like. In aspects of the present invention, the weight of mud used in the MPD system may be varied to help increase/reduce the bottom hole pressure.

Figure 3:
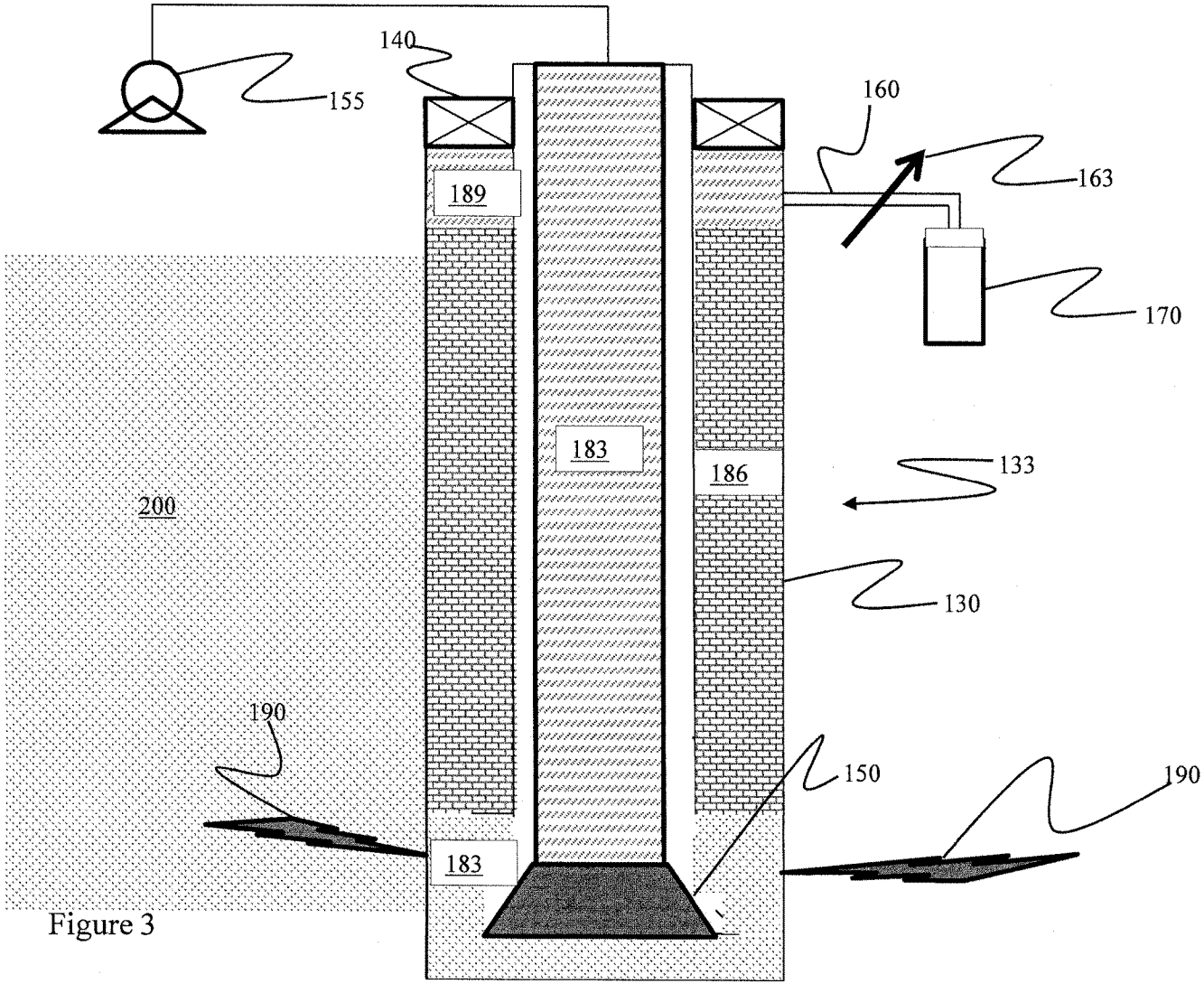
FIG. 3 illustrates a testing while fracturing while drilling procedure, in accordance with an embodiment of the present invention, in which a volume of a heavy, high density drilling fluid 186 has been pumped down the drillstring and into the drilling annulus.

FIG. 3 illustrates a testing while fracturing while drilling system in operation, in accordance with embodiments of the present invention. As noted above, in development of certain hard and low permeability reservoirs, the most common drilling strategy is to drill the well (casing and perforating is an option, but not always necessary) and then fracture and complete the well. It is only after these operations have been completed that the well can be tested and the potential of the reservoir, as perforated by the completed wellbore, evaluated.

In one embodiment, the present disclosure provides a process to evaluate the potential of the reservoir as perforated by a wellbore before the drilling operation has been completed. In aspects of the present invention, the decision to fracture and complete the well may be made with a significantly higher certainty based on the actual reservoir characteristics rather than the expectation based on off-set well and other predictive data.

In an embodiment of the present invention, during the drilling process, pressure in the wellbore 133 is raised above the fracture pressure for a formation 200 surrounding the wellbore producing a fracture in the formation 200. Drilling fluid flowing out of the annulus through a conduit 160 may be choked by a choke 163 to increase the pressure of the drilling fluid in the drilling annulus and thus the BHP in the wellbore 133. The drilling fluid may flow through the conduit 160 to a mud pit 170 where the drilling fluid may be processed and pumped back into the wellbore by a pump 155. The flow rate of the drilling fluid produced by the pump 155 may also be used to control the BHP in the wellbore 133.

In an embodiments of the present invention, the wellbore pressure is then dropped below a pore pressure of the formation 200 surrounding the wellbore so that reservoir/formation fluids flow from the formation 200 into the wellbore 133, where properties of the flowing reservoir fluids can be measured to determine the performance of the reservoir as perforated by the wellbore in its current condition. Lowering of the wellbore/BHP may be achieved, by among other things, pumping gas into the drilling annulus, reducing weight/density of the drilling fluid circulating in the wellbore, adjusting the choke 163, adjusting the pump rate from the pump 155 and/or the like. A processor or the like (not shown) may be used to control the pump 155, the choke 163 and the other apparatus in the drilling system. The processor may receive feedback from sensors and apparatus in the drilling system and may process a BHP from this feedback and control the drilling system accordingly.

In some embodiments of the present invention, the reservoir/formation fluids are flowed into the wellbore during drilling while drilling fluids are circulating through the wellbore. As such, sensors may be used that can differentiate the drilling and formation fluids and/or that have been calibrated for the drilling fluids. In other aspects of the present invention, a process or may process the measurements from the sensors to account for presence of the drilling fluid. In some embodiments of the present invention, the sensors may be disposed on the drill string, which is still present in the well during the fracturing of the formation and the flowing of the formation fluids into the well.

The bottom hole pressure of the wellbore 133 is the sum of the surface pressure, the hydrostatic head of all of the fluids in the well and the frictional pressure drop driving the fluid up the well. In embodiments of the present invention, the surface pressure, the hydrostatic head of all of the fluids in the well and/or the frictional pressure drop driving the fluid up the well may be used to modulate the bottom hole pressure to provide for the pressure changes in the testing while fracturing while drilling process.

In regular drilling operations, the drilling annulus is left open so the surface pressure is effectively atmospheric pressure. In MPD the drilling annulus is capped by a drilling annulus sealing mechanism 140, such as rotating control devices ("RCDs") or the like. The drilling annulus sealing mechanism 140 allows the surface pressure to be increased. Under dynamic (rotating) conditions, the surface pressure may be increased to 200-400 psi. Under static (non-rotating) conditions, the pressure can be up to double this limit. In MPD, higher surface pressures may be achieved using a blow-out-preventer ("BOP"), pipe rams and or an annular preventer to provide even higher annular pressures.

In some embodiments, the BHP may be changed by changing the drilling fluid/mud weight/density. In such embodiments, it is not necessary to displace the entire volume of one weight of mud from the wellbore/drilling annulus with a drilling fluid/mud having a different weight/density. Instead, in aspects of the present invention, a volume of a new weight mud to provide a desired BHP is pumped around the system so that delivery of a portion of the volume of the new weight mud in the drilling annulus provides sufficient length of the new weight mud and sufficient density difference to provide a desired change in BHP.

In some embodiments, gas injection into the drilling annulus may be used to modify the weight of the drilling fluid in the drilling annulus and control the BHP. Use of gas injection in some embodiments of the present invention may provide for bringing some control/flexibility to the management of the BHP. For example, in a multiphase MPD system, changes in choke pressure can be amplified and provide much larger changes in bottom hole pressure due to the effect of pressure on gas and mixture density. However, the compressible gas phase may make detection and interpretation of the influx of reservoir fluids more difficult.

In FIG. 3 the illustrated fracturing while drilling procedure, in accordance with an embodiment of the present invention, comprises a heavy, high density drilling fluid 186, which has been pumped down the drillstring and into the drilling annulus. The heavy drilling fluid 186 has displaced a regular weight drilling fluid 189 from at least a section of the drilling annulus. When the length of the heavy drilling fluid 186 in the drilling annulus provides a sufficient increased in the BHP, a fracture(s) 190 is created in the formation 200.

In some embodiments of the present invention, a volume of a fracturing fluid 183 may be pumped into the drillstring following the heavy drilling fluid 186. The fracturing fluid 183 may comprise a clean fluid or a proppant loaded fluid. In an embodiment of the present invention, the heavy drilling fluid 186 and the fracturing fluid may be pumped into the wellbore 133 such that when a sufficient height of the heavy drilling fluid 186 for fracturing the formation 200 is disposed in the drilling annulus, the fracturing fluid 183 is disposed at the bottom of the wellbore 133 and/or across the reservoir interval for the fracturing operation. This positioning of the fracturing fluid 183 across the reservoir interval, may, among other things, mitigate formation damage during fracturing and ensure a useful fracture remains open for the testing of the properties of the flow of the formation fluids.

In embodiments of the present invention, monitoring of the wellbore is very important. For example, in certain aspects, a surface multiphase flowmeter (not shown), a fluid tracking (Flair) type system (not shown) and/or the like may be used to measure properties of the flow of the drilling fluid. Down hole instrumentation including bottomhole pressure sensors pressure sensors along the drill string may be used to measure pressure in the wellbore 133. MWD tools may be used to measure properties of the formation 200. In aspects of the present invention, wellbore measurements of pressure and/or flow and/or formation measurements may be used to determine a fracturing pressure, enhance the interpretation of the influx of the reservoir fluids as well as enabling improved pressure control. In some aspects, temperature measurements may be used to evaluate the type of fluid influx into the wellbore 133 from the formation 200, condition of fluid influx into the wellbore 133 from the formation 200 and/or the like. In some aspects of the present invention, acoustic sensors may be to track the different fluids in the wellbore 133.

In some aspects of the present invention, sealing fluids may be pumped down the wellbore subsequent to the heavy drilling fluid 186 to provide sealing the fractures after the properties of the flow of reservoir fluids have been tested. Sealing the fractures will prevent fluid loss to the formation 200 when the drilling operation resumes.

In embodiments of the present invention, the pressures associated with the drilling system are modulated to overcome the fracture pressure of the formation. To effectively modulate these pressures, it may be necessary to consider the surface pressure and flow limits for the wellbore fluids. The limiting parameters on the operation of the drilling system to produce fractures while drilling include:

- Rotating control device (RCD) parameters, annulus parameters, blow out preventer (BOP) parameters, such as setting of the BOP during operation and choke pressure;
- Pump and stand-pipe pressure; and
- Pump rate and power.

Dependent on the limiting parameter, in embodiments of the present invention, the drilling procedure may be operated so as to minimize one of the parameters. In situations where the drilling procedure is pump pressure limited, but not annulus pressure limited, a "U" tubing effect may be used to create the pressure in the wellbore to produce fracturing. The "U" tubing effect occurs when the heavy fluid is being pumped down the drill pipe and the increase hydrostatic head in the drill pipe accelerates the flow of the drilling fluids circulating in the wellbore so that the choke on the annulus must be closed to slow the flow, which has the result of increasing the annulus pressure, as desired for fracturing of the formation 200, while keeping the pump pressure at a lower level (minimizing the limited pump pressure parameter). In some embodiments, the heavy drilling fluid 186 is used as the fracturing fluid and, as a result, at least a portion of the heavy drilling fluid 186 is lost to the formation and will not have to be lifted out of the wellbore.

Figure 4:
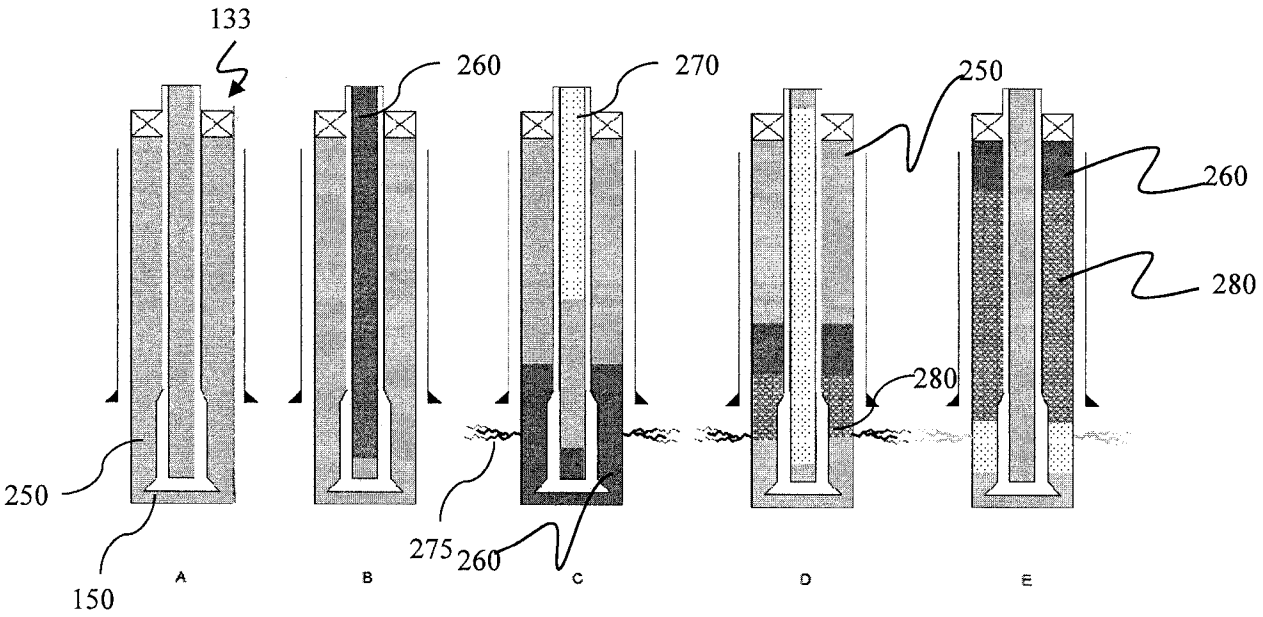
FIG. 4 provides a sequential-type illustration of a testing while fracturing while drilling procedure, in accordance with an embodiment of the present invention.

FIG. 4 provides a sequential-type illustration of a testing while fracturing while drilling procedure, in accordance with an embodiment of the present invention. In embodiments of the present invention, since only a restricted amount of fracturing is required—just enough to provide for flow of the reservoir fluids into the wellbore—and because in some aspects it may be desirable to continue drilling when the testing of the flow of reservoir fluids is completed, the sequence of fluid density/weight and fluid properties of the fluids circulated in the wellbore can be modified to enhance the drilling procedure.

In step A, in the testing while fracturing while drilling procedure a steady circulation of a normal drilling mud 250 occurs and the drilling procedure may be in drilling mode, i.e., the drilling system is drilling the wellbore through an earth formation.

In step B, a volume of a heavier mud 255 may be introduced into the drilling fluids circulating in the wellbore. The heavier mud 255 increases the bottom hole pressure in the wellbore. In aspects of the present invention, the heavier mud 255 may be introduced into the wellbore when the drilling of the borehole has ceased and/or when the drill bit has been pulled back from the bottom of the wellbore. In embodiments of the present invention, the volume and/or flow rate of the heavier mud 255 is configured to provide a hydrostatic head that increased the BHP beyond the fracturing pressure to produce fractures 275 in the earth formation (not shown). In embodiments of the present invention, the top hole pressure may also be manipulated/managed using a choke or the like. The control of the top hole pressure may be used in combination with the heavier mud 255 to control the BHP.

In step C, after the heavier mud 255 is introduced in to the wellbore, a volume of a fluid loss mud 270 may be pumped into the wellbore. The fluid loss mud 270 may comprise a regular drilling mud, such as the normal mud 250, and a fluid loss agent. In embodiments of the present invention, a processor may process circulation hydraulics calculations to determine the different mud volumes and the pressures required to exceed the fracture pressure of the formation. The processor (not shown) may control the pumps (not shown) and/or the choke (not shown) to provide the calculated mud flows and the calculated pressures in the wellbore.

In step D, the testing while fracturing while drilling process, in accordance with embodiments of the present invention, is controlled to provide for inflow of reservoir fluids 280 into the wellbore 133. In embodiments of the present invention, after the heavier mud 255 has passed through the drill bit 150, some of the heavier mud 255 may be lost through the fractures 275. This loss reduces the overall volume of the heavier mud 255 in the circulating fluid flow, and thus results in a reduction in the bottomhole pressure. In embodiments of the present invention, the amount of the heavier mud 255 is selected and/or other pressure management controls, such as choke, surface pressure, gas injection and/or the like, are controlled to provide that the BHP is reduced below the formation fracture pressure/the formation pressure. In embodiments of the present invention, reduction of the BHP below the reservoir pressure results in a flow of the reservoir fluids 280 into the wellbore 133. At this point, testing apparatus on the drillstring and or the like may be used to test the properties of the flow of the reservoir fluids 280 into the wellbore 133. In embodiments of the present invention, properties of the flow of the reservoir fluids 280 that are tested may include: flow rate, temperature, pressure, composition, density, phase (such as oil, gas, water, liquid phase and/or phase ratios), resistivity, conductivity and/or the like. In embodiments of the present invention, monitoring the flow of the reservoir fluids 280 into the wellbore 133 can yield the reservoir flow potential.

In step E, the fractures 275 are sealed to prevent further influx of the reservoir fluids 280 into the wellbore 133. In embodiments of the present invention, after testing the formation fluids 280, the fluid loss mud 270 will have contacted the formation for a sufficient period of time to seal the wellbore 133 and this will prevent loss of drilling mud to the formation, increasing the BHP and returning the wellbore to normal circulation. In embodiments of the present invention, the properties of the fluid loss mud 270, the composition/volumes of the drilling muds in the train of drilling muds flowed through the wellbore 133, the surface pressure, use of gas injection and/or the like may be used to control the amount of time the wellbore 133 has the required pressure for the reservoir fluids 280 to flow into the wellbore 133. In embodiments of the present invention, MWD sensors may be used to measure properties of the flow of the reservoir fluids 280 into the wellbore 133.

In embodiments of the present invention, after Step E or during Step E, the drilling of the wellbore may recommence. In embodiments of the present invention, the testing of flow of the reservoir fluids 280 into the wellbore 133 may occur without completion of the well, while the drill bit/drillstring is still in the wellbore 133 and/or the like. In embodiments of the present invention, a determination regarding continuing drilling the wellbore, parameters for continuing drilling of the wellbore (such as drilling direction or the like), fracture placement in the wellbore 133 and/or the like may be determined from the measurements made on the reservoir fluids 280 flowing into the wellbore 133 during the testing while fracturing while drilling procedure.

In embodiments of the present invention, coiled tubing or the like may be used to introduce one of the fluids, such as the heavier mud 255, the fluid loss mud 270 and/or the like, into the wellbore 133. As noted previously, gas injection may be used to control the BHP during the testing while fracturing while drilling procedure. Gas injection may provide for fine tuning, real time control, more accurate control and/or more effective control of the BHP in combination with the mud-train BHP control.

Figure 5:
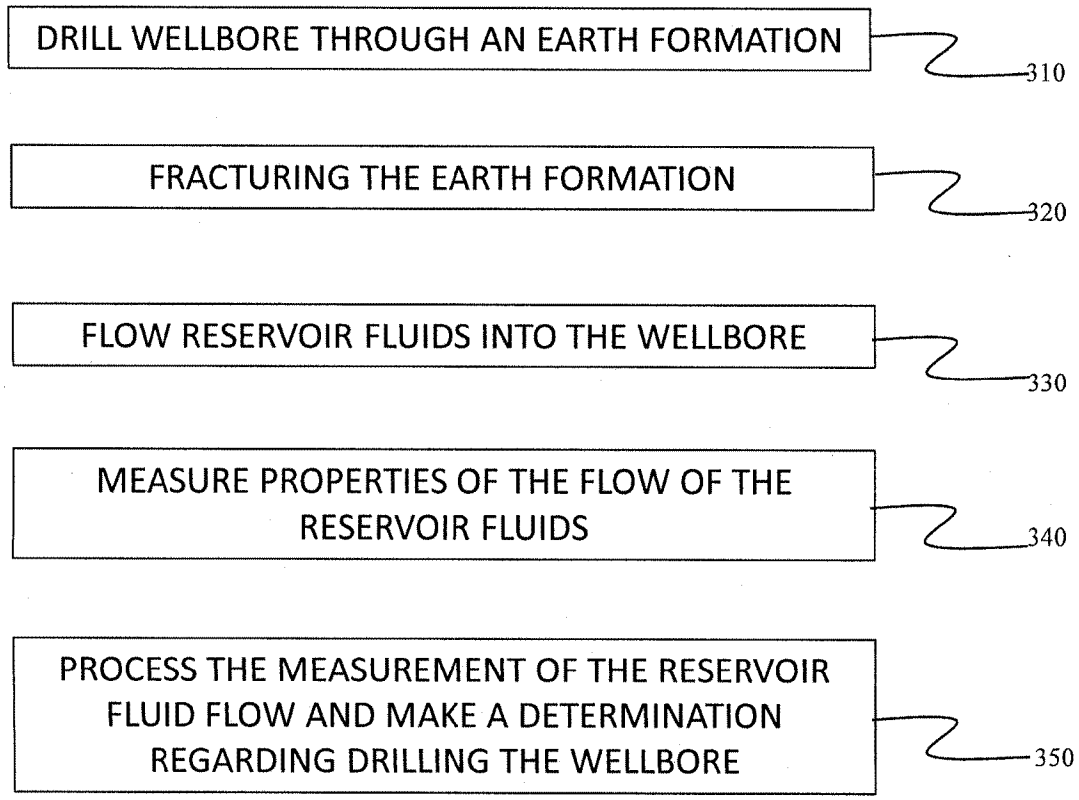
FIG. 5 is a flow-type illustration of a method for testing while fracturing while drilling procedure, in accordance with an embodiment of the present invention.

FIG. 5 is a flow-type illustration of a method for testing while fracturing while drilling procedure, in accordance with an embodiment of the present invention.

In step 310, a drilling operation is proceeding in which a drilling system is drilling a wellbore through an earth formation to/through a hydrocarbon reservoir in the earth formation. The drilling process may be a conventional drilling process, a MPD drilling process or the like. In the drilling process a drilling mud may be circulated through the wellbore. The drilling mud may have a weight selected to maintain the BHP in a desired pressure window that is designed to prevent fracturing the formation or allowing influx of formation fluids into the wellbore.

In step 320 the earth formation is fractured. In embodiments of the present invention, the formation is fractured while drilling, i.e., with the drill bit/drillstring still in the wellbore. In embodiments of the present invention, by fracturing the formation without tripping the drill bit, drilling time may be saved as the drill bit is in position for continued drilling.

In aspects of the present invention, the fracturing of the drilling may be produced by raising the BHP above a fracture pressure of the formation. The fracture pressure may in some aspects be calculated from measurement made on the formation, modeling of the formation and/or the like. The BHP may be controlled to produce the fracture by controlling a surface choke that chokes the flow of drilling fluid out of the drilling annulus, the weight of the mud being circulated though the wellbore, the pump rate of the mud, injection of gas into the mud and/or the like. Packers, a collar on the drillstring and/or the like may be used to isolate a section of the wellbore where the formation is to be fractured and/or to provide for increasing the BHP within a section of the wellbore.

In step 340, reservoir fluids are flowed into the wellbore from the reservoir. In embodiments of the present invention, to produce the flow of the reservoir fluids into the wellbore, the BHP is reduced below the pore pressure of the reservoir. This means that the BHP pressure has to be reduced from the fracturing pressure to a lower pressure, this reduction in pressure may be achieved by loss of drilling fluid into the reservoir, reducing weight of the mud flowing in the wellbore/drilling annulus, injection of gas into the drilling fluid, reduction of surface pressure, opening chokes or the like, adjusting pump rate for the drilling fluid into the wellbore and/or the like. In some aspects of the present invention, the BHP may be measured directly by pressure sensors on the drillstring, bottomhole assembly and/or the like. In other aspects, the BHP may be processed from drilling parameters such as mud weight, pump rate, choke position, drillstring frictional properties, drilling annulus frictional properties, gas injection properties, flow rate of drilling mud into and out of the wellbore and/or the like.

In step 340, properties of the flow of the reservoir fluids into the wellbore are measured. These properties may be measured by sensors on the drillstring such as MWD sensors or the like. In embodiments of the present invention, by keeping the drill string in the wellbore it is possible to use sensors on the drillstring to measure formation fluid properties without the need to use wireline tools. The measured properties may include flow rate, phase of the flow, fluid analysis of the composition of the flow, ratios of the phases of the flow, water content, salinity of the flow, resistivity of the flow, capacitance of the flow, density of the flow, temperature of the flow, viscosity of the flow and/or the like.

In step 350 the measurements are processed and a determination with respect to the drilling of the wellbore may be made. For example, the measurements may be processed to characterize production properties of the reservoir at the location of the fracture(s). These production properties may include expected rates/volumes of the different hydrocarbons that are expected to be produced if the wellbore were completed. In embodiments of the present invention, problems with production from the wellbore may be determined from the processed measurements, such as low flow rates, undesirable phase ratios and/or the like. From the processed measurements, a determination with respect to drilling the wellbore may be made. Such determinations may include, stop drilling and complete the well, continue drilling the well, change direction of drilling the well, where to place a fracture in the formation and/or the like. In embodiments of the present invention, because the well has not been completed and/or the drill string is still in the well, continued drilling/fracturing may occur essentially immediately. Once the further drilling has reached a new target location, the fracturing, testing and determination steps may be repeated.

In some embodiments, the different weight drilling fluids may be pumped through the wellbore in a fluid train and a clean fluid and/or a fluid containing a proppant may be pumped into the wellbore in the train to provide for effective fracturing of the formation during the drilling process. A processor may be used to process volumes, pump rates and/or weights of the different fluids in the train to provide for positioning of the fluids in desired locations in the well. In some embodiments, a sealing fluid may be pumped into the wellbore after the testing of the formation fluids so as to seal fractures in the subterranean formation. In some embodiments, coiled tubing may be used to inject one of more of the fluids into the drilling annulus.

While the principles of the disclosure have been described above in connection with specific apparatuses and methods, it is to be clearly understood that this description is made only by way of example and not as limitation on the scope of the invention.

What is claimed is:

1. A method for performing a drilling procedure to drill a wellbore into a subterranean formation to produce hydrocarbons from a hydrocarbon reservoir therein, comprising:

using a drilling system comprising a drillstring and a drill bit to drill the wellbore into the subterranean formation, wherein the drilling procedure comprises circulating drilling fluids through the wellbore, down the drillstring and up through a drilling annulus;

fracturing a section of the subterranean formation at a location along the wellbore;

pumping a low density drilling fluid into the wellbore to decrease the bottom hole pressure below a pressure of the subterranean formation, thereby flowing formation fluids from the subterranean formation into the wellbore at the location prior to completing the wellbore; and measuring properties of the flow of formation fluids into the wellbore.

2. The method according to claim 1, wherein at least one of the steps of fracturing the section of the fracturing the section of the subterranean formation and flowing formation fluids into the wellbore are performed with the drillstring in the wellbore.

3. The method according to claim 2, further comprising:

making a drilling decision based upon the measured properties of the flow of the formation fluids into the wellbore, wherein the drilling comprises at least one of continuing drilling the wellbore, completing the wellbore, determining where to induce a further fracture in the subterranean formation and determining a direction in which to continue drilling the wellbore.

4. The method according to claim 1, wherein the measured properties are used to process a production model for the wellbore prior to completing the wellbore.

5. The method according to claim 1, wherein the measured properties of the formation fluids comprise at least one of a flow rate of the formation fluids into the wellbore, a composition of the reservoir fluids, a phase of the reservoir fluids, a phase fraction of the reservoir fluids, a gas cut of the reservoir fluids, a water cut of the reservoir fluids, an oil cut of the reservoir fluids, a conductivity pr resistivity of the reservoir fluids, a temperature of the reservoir fluids, a pressure of the reservoir fluids, density of the reservoir fluids, a viscosity of the reservoir fluids and a volume flow rate of the reservoir fluids.

6. The method according to claim 1, wherein the properties of the formation fluids are measured by one or more sensors disposed on the drillstring.

7. The method according to claim 1, wherein the step of fracturing the section of the subterranean formation comprises pumping a high density drilling fluid into the wellbore to increase the bottom hole pressure.

8. The method according to claim 1, wherein the step of fracturing the section of the subterranean formation comprises using a choke to choke a flow of the drilling fluid out of the drilling annulus and increase the bottom hole pressure.

9. The method according to claim 1, wherein the step of pumping a low density drilling fluid into the wellbore and flowing formation fluids into the wellbore also comprises adjusting a choke to reduce an amount of choke applied to a flow of the drilling fluid out of the drilling annulus and increase the bottom hole pressure.

10. The method according to claim 1, wherein the drilling system comprises a managed pressure drilling system.

11. The method according to claim 10, wherein the step of pumping a low density drilling fluid into the wellbore and flowing formation fluids into the wellbore comprises injecting a gas into the drilling fluid to decrease a bottom hole pressure below a pressure of the subterranean formation.

12. The method according to claim 1, further comprising:

continuing drilling of the wellbore after measuring the properties of the flow of formation fluids into the wellbore.

13. The method according to claim 1, wherein the properties of the flow of formation fluids into the wellbore are measured while the drilling fluid is being circulated through the wellbore.

14. The method according to claim 1, wherein the step of measuring properties of the flow of formation fluids into the wellbore comprises using sensors on the drill string to measure the properties of the flow of the formation fluids.

15. A method for performing a drilling procedure to drill a wellbore into a subterranean formation to produce hydrocarbons from a hydrocarbon reservoir therein, comprising:

using a drilling system comprising a drillstring and a drill bit to drill the wellbore into the subterranean formation, wherein the drilling procedure comprises circulating drilling fluids through the wellbore, down the drillstring into a bottom of the wellbore and up through a drilling annulus;

pumping a first drilling fluid into the wellbore;

pumping a second drilling fluid with a density higher than the first drilling fluid into the wellbore to increase a pressure at the bottom of the wellbore;

fracturing the subterranean formation;

pumping a third drilling fluid with a density lower than the second drilling fluid into the wellbore;

lowering the pressure at the bottom of the wellbore below a pressure of the subterranean formation; and measuring properties of a flow of formation fluids flowing from the subterranean formation into the wellbore.

16. The method according to claim 15, wherein the third drilling fluid comprises the first drilling fluid.

17. The method according to claim 15, wherein the step of fracturing the subterranean formation comprises at least one of choking a flow of the second drilling fluid out of the wellbore and increasing a rate of pumping the second drilling fluid into the wellbore.

18. The method according to claim 15, further comprising:

pumping one of a clean fluid and a fluid containing a proppant into the wellbore after the second drilling fluid is pumped into the wellbore.

19. The method according to claim 15, further comprising:

pumping a sealing fluid into the wellbore to seal fractures in the subterranean formation.

20. The method according to claim 19, further comprising:

increasing the pressure at the bottom of the wellbore above the pressure of the subterranean formation and continuing drilling the wellbore.

21. The method according to claim 15, wherein the first, second and third drilling fluids are pumped through the wellbore as a fluid train.

22. The method according to claim 15, wherein at least one of the first, second and third drilling fluids are injected into the drilling annulus using coiled tubing.

23. The method according to claim 15, wherein the drillstring comprises wired drillstring and the measurements are communicated to a surface via the wired drillstring.

24. A method for performing a drilling procedure to drill a wellbore into a subterranean formation to produce hydrocarbons from a hydrocarbon reservoir therein, comprising:

using a managed pressure drilling system comprising a drillstring and a drill bit to drill the wellbore into the subterranean formation, wherein the drilling procedure comprises circulating drilling fluids through the wellbore, down the drillstring and up through a drilling annulus surrounding the drillstring, wherein return flow out of the annulus at the surface is controlled with an adjustable choke;

drilling while restricting flow out of the annulus by means of the choke so as to maintain a surface pressure in the annulus and maintain a downhole pressure above a pressure of the subterranean formation to prevent entry of formation fluids but without fracturing the surrounding subterranean formation;

increasing downhole pressure and thereby fracturing a section of the subterranean formation at a location along the wellbore;

after fracturing at the said location, opening the choke and reducing downhole pressure below the pressure of the subterranean formation to allow flow of formation fluids from the subterranean formation into the wellbore at the location prior to completing the wellbore; and measuring properties of the flow of formation fluids into the wellbore.

25. The method according to claim 24, wherein at least one of the steps of fracturing the section of the subterranean formation and flowing formation fluids into the wellbore are performed with the drillstring in the wellbore.

26. The method according to claim 24, further comprising making a drilling decision based upon the measured properties of the flow of the formation fluids into the wellbore, wherein the drilling decision comprises at least one of continuing drilling the wellbore, completing the wellbore, determining where to induce a further fracture in the subterranean formation and determining a direction in which to continue drilling the wellbore.

27. The method according to claim 24, wherein the measured properties are used to process a production model for the wellbore prior to completing the wellbore.

28. The method according to claim 24, wherein the measured properties of the formation fluids comprise at least one of a flow rate of the formation fluids into the wellbore, a composition of the reservoir fluids, a phase of the reservoir fluids, a phase fraction of the reservoir fluids, a gas cut of the reservoir fluids, a water cut of the reservoir fluids, an oil cut of the reservoir fluids, a conductivity pr resistivity of the reservoir fluids, a temperature of the reservoir fluids, a pressure of the reservoir fluids, density of the reservoir fluids, a viscosity of the reservoir fluids and a volume flow rate of the reservoir fluids.

29. The method according to claim 24, wherein the step of fracturing the section of the subterranean formation comprises pumping a high density drilling fluid into the wellbore to increase the bottom hole pressure.

30. The method according to claim 24, wherein the step of opening the choke and reducing downhole pressure also comprises one of pumping a low density drilling fluid into the wellbore and injecting a gas into the drilling fluid.

31. The method according to claim 24, further comprising continuing drilling of the wellbore after measuring the properties of the flow of formation fluids into the wellbore.

32. The method according to claim 24, wherein the properties of the flow of formation fluids into the wellbore are measured while the drilling fluid is being circulated through the wellbore.

33. The method according to claim 24, wherein the step of measuring properties of the flow of formation fluids into the wellbore comprises using sensors on the drill string to measure the properties of the flow of the formation fluids.

* * * * *